United States Patent [19]

Redman et al.

[11] 3,930,748

[45] Jan. 6, 1976

[54] HOLLOW COOLED VANE OR BLADE FOR A GAS TURBINE ENGINE

[75] Inventors: Robert Frederick Redman, Beeston; Michael John Sharpe, Derby, both of England

[73] Assignee: Rolls-Royce (1971) Limited, London, England

[22] Filed: July 27, 1973

[21] Appl. No.: 383,055

[30] Foreign Application Priority Data

Aug. 2, 1972 United Kingdom ..... 36058/72

[52] U.S. Cl. ..... 416/97; 415/115

[51] Int. Cl.[2] ..... F01D 5/18

[58] Field of Search..... 416/92, 96 A, 97 A, 95–97; 415/115

[56] References Cited

UNITED STATES PATENTS

| | | | |
|---|---|---|---|
| 2,787,441 | 4/1957 | Bartlett | 416/92 |
| 2,873,944 | 2/1959 | Wiese et al. | 416/92 |
| 2,923,525 | 2/1960 | Creek | 416/92 |
| 3,240,468 | 3/1966 | Watts et al. | 416/97 |
| 3,388,888 | 6/1968 | Kercher et al. | 415/115 |
| 3,433,015 | 3/1969 | Sneeden | 415/115 |
| 3,574,481 | 4/1971 | Pyne et al. | 416/97 X |
| 3,628,880 | 12/1971 | Smuland et al. | 416/97 X |
| 3,628,885 | 12/1971 | Sidenstick et al. | 416/97 |
| 3,635,587 | 1/1972 | Giesman | 416/97 |
| 3,644,060 | 2/1972 | Bryan | 416/97 |
| 3,700,348 | 10/1972 | Corsmeier et al. | 416/95 X |
| 3,707,750 | 1/1973 | Klass | 416/96 A UX |
| 3,782,852 | 1/1974 | Moore | 416/97 |
| 3,799,696 | 3/1974 | Redman | 416/97 |
| 3,806,276 | 4/1974 | Aspinwall | 416/97 |

FOREIGN PATENTS OR APPLICATIONS

| | | | |
|---|---|---|---|
| 243,324 | 9/1969 | U.S.S.R. | 416/96 |
| 833,770 | 4/1960 | United Kingdom | 416/96 A |

*Primary Examiner*—Everette A. Powell, Jr.
*Attorney, Agent, or Firm*—Cushman, Darby & Cushman

[57] ABSTRACT

A hollow cooled blade or vane for a gas turbine engine has a cooling air entry tube sealed to its hollow interior at spaced apart locations to provide a space which is divided into longitudinal sections by longitudinal partitions. Each section is provided with cooling air through apertures in the tube and at least one has film cooling holes extending to the blade surface.

14 Claims, 6 Drawing Figures

HOLLOW COOLED VANE OR BLADE FOR A GAS TURBINE ENGINE

The invention relates to a hollow cooled vane or blade for a gas turbine engine. Throughout this specification the term blade is to be understood to include rotor and stator blades and vanes.

It is well known to cool blades for gas turbine engines by passing cooling air up the hollow interior of the blades and allowing it to flow through film cooling holes which pass from the inside to the outside of the blade. However, the pressure on the surface of the blade varies from being very high at the leading edge to relatively low on the convex, low pressure face of the blade. Thus the pressure of cooling air sufficient to cause air to flow satisfactorily from holes at one position on the blade profile may be too high or too low to cause air to flow satisfactorily from holes at other positions on the blade.

The present invention provides a construction in which the cooling air pressure may be arranged to be different at different portions of the interior surface of the blade.

According to the present invention a hollow cooled blade for a gas turbine engine comprises a cooling air entry tube extending longitudinally of the blade interior and sealed onto the blade interior at spaced apart locations to provide a substantially sealed space between the tube and the blade interior, and longitudinally extending partitions which seal between the blade interior and the external surface of the tube, said partitions dividing said space between the tube and the blade interior into a plurality of separate longitudinal sections, apertures in the tube adapted to allow air at different pressures into the different sections, and film cooling air holes extending from at least one of said sections through the blade wall to the exterior blade surface.

Said hollow blade may comprise a single hollow central portion within which the tube is located or may comprise a leading hollow portion within which the tube is located, the trailing portion of the blade being provided with a sinuous passage for cooling air.

Alternatively there may be two said tubes located in the forward and rearward parts of the hollow in the blade; these forward and rearward parts may be separated by a web.

Said partitions may comprise longitudinally extending projections from the internal surface of the blade, or they may comprise hollow tubes or other deformable sealing members which are trapped between the tube and the blade.

The tube may be solely located in the blade by the partitions or there may be chordwise extending fins from the blade interior which additionally support the tube.

In the simplest case there may be two separate longitudinal sections between the tube and the blade, although there may clearly be a greater number as required.

Figure 1:
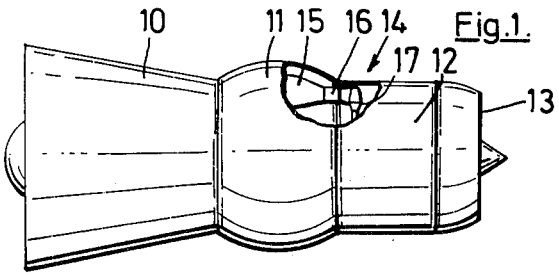
Figure 2:
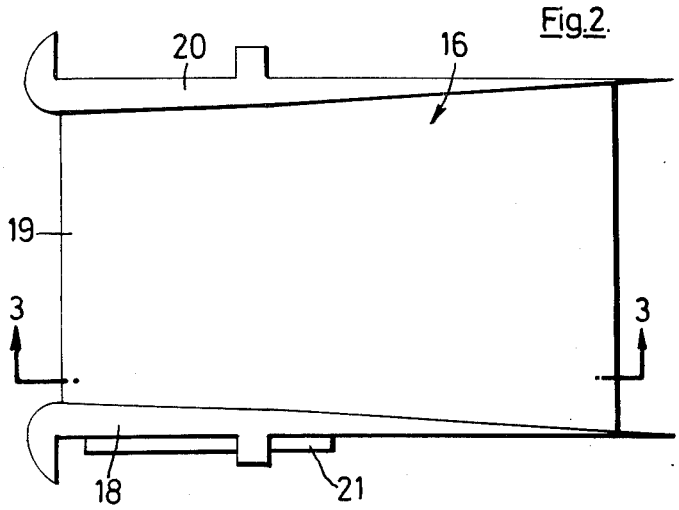
Figure 3:
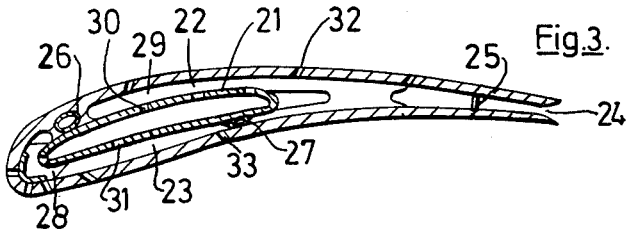
Figure 4:
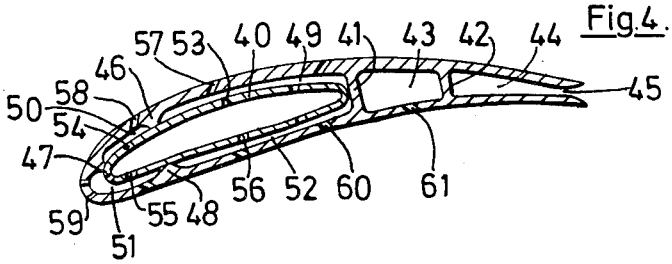
Figure 5:
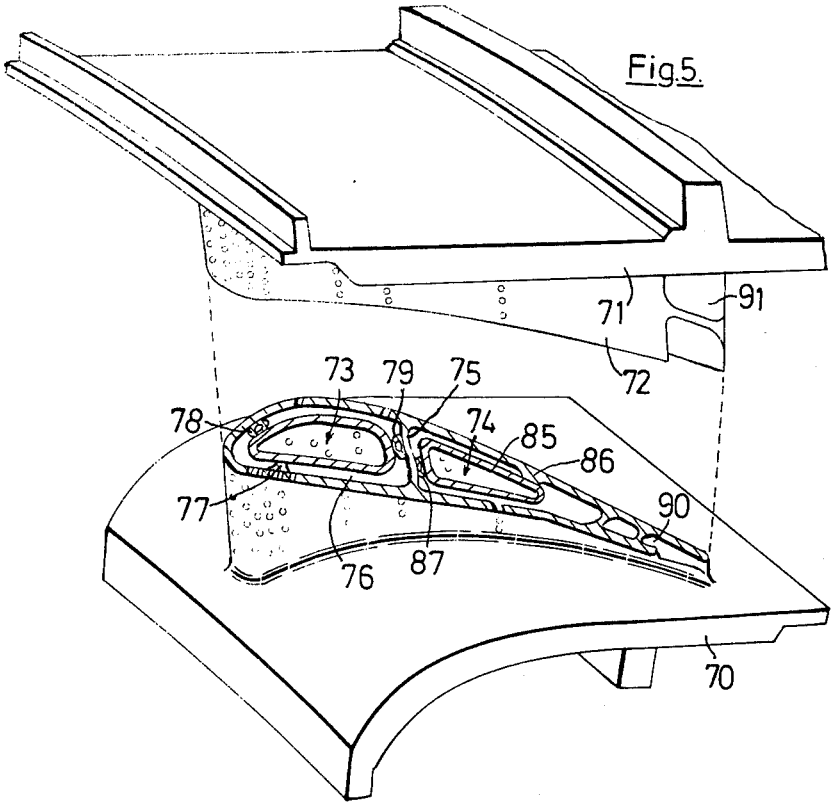
Figure 6:
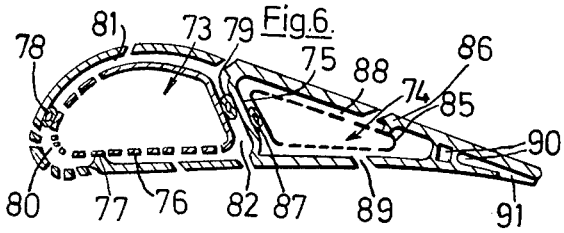

The invention will now be particularly described, merely by way of example, with reference to the accompanying drawings in which:

FIG. 1 is a partly broken away view of a gas turbine engine incorporating vanes in accordance with the invention, FIG. 2 is an enlarged side elevation of one of the vanes of FIG. 1, FIG. 3 is a section on the line 3—3 of FIG. 2, FIG. 4 is a section similar to that of FIG. 3 but of a further embodiment, FIG. 5 is a broken-away perspective view of a further embodiment and FIG. 6 is a section similar to that of FIGS. 3 and 4 of the embodiment of FIG. 5.

In FIG. 1 there is shown a gas turbine engine comprising a compressor section 10, combustion section 11, turbine section 12 and final nozzle 13. The casing of the engine is broken away at 14 to show the combustion chamber 15, nozzle guide vanes 16 and turbine rotor 17. The nozzle guide vanes 16 are shown enlarged in FIG. 2.

The guide vane comprises an inner platform section 18, an aerofoil section 19 and an outer platform section 20. The aerofoil section 19 is hollow and inside its hollow center is retained a cooling air entry tube 21 which projects slightly below the inner platform 18. A cooling air supply is arranged to deliver cooling air to the lower surface of the platform 18 and hence to the interior of the cooling air tube 21; the platform 18 is sealed to the tube and the tube is sealed at its other end to the platform 20 so as to seal this end of the tube, and thus to produce a substantially sealed space between the tube and the blade interior.

In FIG. 3 there are shown details of the interior construction of the blade. The internal surface of the aerofoil section is provided with chord-wise extending fins 22 and 23 from the concave and convex interior surface respectively, and which support the tube 21. The fins merge at their trailing edges to form a single strut across the blade interior. This single strut does not extend completely to the blade trailing edge and at the trailing edge a longitudinal slot 24 is formed. There are also pedestals 25 which interconnect the two blade faces adjacent the trailing edge slot 24.

In order to divide the space between the tube 21 and the blade inner surface into longitudinal sections, resilient sealing tubes 26 and 27 are held in cut-away portions of the fins 22 and 23 respectively and are trapped between the tube 21 and the blade interior. The resilience of the tubes enables them to be put under compression to hold them in place and to effect a proper seal against the blade and tube, although it may be desirable to braze or otherwise metallurgically fasten the tubes; the seal may in practice be not completely perfect.

It will be seen that the tubes 26 and 27 effectively divide the area between the air tube 21 and the blade interior into two longitudinally extending sections, a leading section 28 and a trailing section 29, the leading section extending mainly round the concave, high pressure face of the blade and the trailing section extending mainly round the convex, low pressure face of the blade. The cooling air feed tube 21 has separate sets of apertures 30 and 31 which feed air from the interior of the tube 21 to the leading section 28 and trailing section 29 respectively. These apertures are sized to provide predetermined different pressures of cooling air in the sections 28 and 29, and since the tube 21 is sealed to the platforms 18 and 20 the only source of air to these sections is through the tube 21, although as explained above, the sealing may in practice not be perfect and there may be some leakage.

To cool the outside of the blade film cooling holes are provided, one set 32 of which passes from the section 29 to the outer face of the blade while the other set 33 passes from the section 28 to the outer face of the blade. The set 32 comprises three parallel rows of holes, the rows extending longitudinally of the blade, while the set 33 comprises five similar rows of holes.

Operation of the cooling system of this embodiment is as follows:

The cooling air is fed to the inside of the tube 21 where it projects from the platform 18 and flows from there through the sets of apertures 30 and 31. Air flowing through the apertures 30 blows on the inside of the blade, providing impingement cooling on the inner surface of the blade. Part of the air then flows through the set of holes 32 to the outer surface of the blade, where it provides film cooling, while the remainder flows rearwardly of the blade to exhaust through the trailing edge slot 24.

Since the set of holes 32 exhausts to the convex, low pressure face of the blade, the pressure of cooling air required to eject film cooling air satisfactorily through the holes is relatively low, and consequently the apertures 30 are arranged to produce a reduction in the pressure of the cooling air passing from the interior of the tube 21 to the section 29.

Air flowing through the apertures 31 similarly provides some impingement cooling of the inner blade surface of the section 28 and then it all exhausts through the set of film cooling holes 33. This provides film cooling of the concave, high pressure surface of the blade. Since the external pressure over this surface is high, it is desirable to arrange that the pressure of the air in the section 28 is as high as possible, at least being in excess of the external pressure. Hence the apertures 31 are arranged to provide little or no restriction to the air flowing from the tube 21.

In FIG. 4 there is shown the cross-section of a second embodiment of blade. The side elevation of the blade is similar to that shown in FIG. 2, and it has inner and outer blade platforms and an aerofoil section but in this case in addition to a cooling air tube 40 projecting from the lower platform, a separate aperture is provided to supply cooling air to a different trailing section cooling arrangement described below. The arrangement of the blade is best seen from FIG. 4.

It will be seen that the hollow interior of the blade is divided by longitudinal diaphragms 41 and 42 into a relatively large forward hollow section and a rearward section comprising two longitudinal passages 43 and 44 which are interconnected adjacent the upper platform where the diaphragm 42 does not reach to the platform. The passage 44 is provided with a trailing edge slot 45 which extends through the trailing edge of the blade. The passage 43 is provided with cooling air from an aperture in the lower platform of the blade adjacent the projection of the tube 40.

The large hollow front portion of the blade is provided with longitudinally extending ribs 46, 47 and 48 which locate the tube 40 and seal against it, the other location of the tube being provided by the diaphragm 41. The tube may be located between the ribs 46, 47 and 48 and the diaphragm 41 by being compressed between these elements or may if necessary be brazed, welded or otherwise fastened to them.

The ribs 46, 47 and 48 are unbroken and form the partitions which divide the space between the tube and the inner surface of the blade into longitudinally extending sections 49, 50, 51 and 52. In a similar fashion to the previous embodiment, apertures are provided in the tube 40 to allow air to flow into these separate sections; thus the sets of apertures 53, 54, 55 and 56 respectively supply air to the sections 49, 50, 51 and 52. Once more film cooling holes are disposed in longitudinal rows and each section is provided with at least one row of holes to allow air to flow to the blade surface. The sets of film holes 57, 58, 59 and 60 respectively connect between the sections 49, 50, 51 and 52 and the blade outer surface.

Operation of the cooling system of the forward blade section is rather similar to that of FIG. 3, in that cooling air flows into the tube 40, out through the sets of apertures 53, 54 55 and 56 to impinge on the inner surfaces of the separate sections and then to provide some impingement cooling. The air then flows through the respective sets of film cooling holes to provide film cooling of the outer surface of the blade.

Since the sections are separate, the apertures in the air entry tube can be sized to provide different pressures in each section and thus to provide a pressure for each set of holes which is tailored to the external pressure on the blade at this set.

The rearmost section of the blade is cooled in the normal multi-pass fashion; thus air is fed into the passage 43, along this passage and into passage 44. It then flows out of the trailing edge slot 45. Additionally, film cooling holes 61 extend from the passage 43 to the high pressure surface of the blade, providing some film cooling on this part of the blade.

It should be noted that in the FIG. 4 embodiment the pressure in the space 52 must be relatively high and consequently the pressure drop across the tube 40 to the space 52 is relatively small. Consequently the impingement cooling of the inner face of the blade adjacent the space 52 may not be very effective.

To improve this cooling it is proposed in a further embodiment (not illustrated) to blank off the holes 60 and to arrange passages adjacent the diaphragm 41 connecting the space 52 with the space 49. Since the pressure on the convex flank of the blade is relatively low, the pressure in space 52 can now be made relatively low and a high pressure drop arranged across the tube 40. Hence the impingement cooling may be improved.

In FIG. 5 there is shown a further embodiment again comprising an inner blade platform 70, outer platform 71 and aerofoil section 72. The interior of the hollow aerofoil section 72 is divided into two portions, a forward portion 73 and a rearward portion 74, by a web 75 which in this case is cast integrally with the blade and seals the portions off from each other.

Within the forward portion 73 is located a forward cooling air feed tube 76 which is similar to the tubes 21 and 40 and which projects beyond the lower platform to be fed with cooling air. At its other end the tube is sealed to the platform 77. The tube 76 is located in the portion 73 inbetween a longitudinally extending rib 77 similar to the ribs 46, 47 and 48 of the FIG. 4 embodiment, and two resilient sealing tubes 78 and 79 similar to the tubes 26 and 27 of the FIG. 3 embodiment.

Support for the tube 76 is provided by chordwise extending ribs or fins (not shown in FIG. 5 but similar to those shown in FIG. 3) which project from the inner surface of the blade and engage with the outer surface of the tube. As in the previous embodiment the rib 77 and tubes 78 and 79 engage with the outer surface of the tube 76 to divide the area between the 76 and the inner surface of the blade in the portion 73 into three separate longitudinally extending sections 80, 81 and 82. In similar fashion to the cases described above the tube 76 is provided with sets of apertures to allow air to flow from its interior into the sections 80, 81 and 82; these apertures are not enumerated in detail but are visible in the drawings. Similarly film cooling holes in the blade allow air which has impinged on the blade interior to flow from the sections 80, 81 and 82 to the outer surface of the blade. These holes are not enumerated since they are similar to those described in the previous embodiments.

The rearward portion 74 of the blade is provided with a rearward cooling air feed tube 85 which is again supported by chordwise extending ribs or fins (not shown in FIG. 5 but similar to those shown in FIG. 3). Once again, the tube 85 seals against the platform 71 and extends through the inner portion 70 to communicate with a supply of cooling air. The outer surface of the tube is sealed to the inner surface of the portion 74 by a longitudinally extending rib 86 similar to the rib 77 and by a resilient sealing tube 87 similar to the tubes 78 and 79. Once more, the rib 86 and tube 87 define spaces 88 and 89 between the tube 85 and the inner surface of the portion 74. The space 88 is fed with air through holes in the tube 85 and air escapes solely through film cooling holes, while the space 89 is fed with air through further holes in the tube. In this case, however, only part of the air flows through the film cooling holes communicating with this space, the remainder flowing rearwardly in between sets of pedestals 90 to exhaust through trailing edge apertures 91; these apertures are formed in the trailing edge portion of the concave flank of the blade and are close to one another to form in effect a complete slot.

Operation of this embodiment will be understood with the assistance of the description of the previous embodiments. Each cooling air tube is provided with cooling air which then flows through the sets of holes in the tube walls to impinge on the inside of the blade to provide cooling, and to provide the required pressures in the sections 80, 81, 82, 88 and 89. The air from these sections is then at the required pressure to discharge through the film cooling holes and provide further cooling of the blades. In the case of the section 89, the majority of the air flows through the trailing edge holes 91 rather than through the film cooling holes; the holes 91 and the pedestals 90 help to maintain the cooling of the thin trailing edge of the blade.

It will be seen that in this embodiment the blade is strengthened by the web 75 and that five separate longitudinal sections are provided. It may be desirable in some circumstances to make the web 75 into a 'ladder' member by forming holes in the web; this may reduce any ill effects due to the rigid web 75 operating in a thermal gradient.

It will also be noted that it may be desirable to delete the web altogether and to have the tubes contiguous in a single hollow blade space.

It will be seen that although the film cooling holes in the above embodiments have been laid out in longitudinal rows in particular locations, it is quite possible to vary this layout; thus the holes may be spaced all over the blade surface, may be in non-longitudinal lines and may be of differing sizes. Again, the number and form of partitions may be varied; obviously the more partitions that are used, the more nearly may the pressure required for each set of film cooling holes be provided, but improvement may be achieved with the simple embodiment of FIG. 3. The partitions themselves may comprise the ribs or tubes of the embodiments, or they may be ribs from the air entry tube, or wires, or separate rib structures.

It is also clear that the principle of the invention may be used for cooling all or any part of a vane or blade, the remainder of which may be cooled by any convenient method.

We claim:

1. A blade assembly for a gas turbine engine comprising: a hollow cooled blade having a wall defined by an exterior and an interior surface, a cooling air entry tube positioned interior of the blade and extending longitudinally of the same, said cooling air entry tube being sealed to the blade interior surface at spaced apart locations at or adjacent the tip and root of the blade to provide a space between the blade and the blade interior surface, means to operatively support said air entry tube from the interior surface of said blade, longitudinally extending partitions which seal between the blade interior surface and the exterior surface of the tube, said partitions dividing said space between the tube and the interior surface of said blade into a plurality of separate longitudinal sections, at least one of said partitions comprising a longitudinally extending deformable sealing member trapped between the respective tube and the interior surface of said blade, apertures in the tube arranged to allow air at different pressures into the different longitudinal sections, and film cooling holes extending from at least one of said sections through the blade wall to the exterior blade surface.

2. A blade as claimed in claim 1 in which at least some of said longitudinal partitions support said cooling air tube.

3. A blade as claimed in claim 1 and comprising a single hollow central portion within which said tube is located.

4. A blade as claimed in claim 3 and in which there is a single said tube located within said hollow central portion.

5. A blade as claimed in claim 1 and in which there are two said tubes located in the forward and rearward parts respectively of said hollow blade.

6. A blade as claimed in claim 4 and in which there is a trailing edge slot in communication with at least one said longitudinal section.

7. A blade as claimed in claim 1 and comprising a leading hollow portion within which the tube is located and a trailing portion which is provided with a sinuous passage for the flow therethrough of cooling air.

8. A blade as claimed in claim 7 and in which there is a trailing edge slot through which the air from said sinuous passage may discharge.

9. A blade as claimed in claim 1 and comprising a forward hollow portion within which one said tube is located and a rearward hollow portion within which a second said tube is located, said forward and rearward hollow portions being separated by a longitudinally extending web.

10. A blade as claimed in claim 9 and in which there is a trailing edge slot with which at least part of the rearward tube communicates so as to discharge air therethrough.

11. A blade as claimed in claim 9 and in which the space between each said tube and the interior of its respective hollow portion is divided into a plurality of longitudinal sections.

12. A blade as claimed in claim 1 and in which at least one said partition comprises an integral longitudinally extending projection from the interior surface of the blade and extending to said tube.

13. A blade as claimed in claim 1 and in which said deformable sealing member comprises a resilient tube.

14. A blade as claimed in claim 1 and in which there are chordwise extending ribs projecting from the blade interior which support the cooling air tube.

* * * * *